US008356876B2

(12) United States Patent
Yoshida

(10) Patent No.: US 8,356,876 B2
(45) Date of Patent: Jan. 22, 2013

(54) MAINTENANCE METHOD FOR LIQUID EJECTING APPARATUS

(75) Inventor: Atsushi Yoshida, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 177 days.

(21) Appl. No.: 13/015,101

(22) Filed: Jan. 27, 2011

(65) Prior Publication Data

US 2011/0187790 A1 Aug. 4, 2011

(30) Foreign Application Priority Data

Feb. 1, 2010 (JP) ..... 2010-020221

(51) Int. Cl.
*B41J 29/393* (2006.01)

(52) U.S. Cl. ..... 347/19; 347/30

(58) Field of Classification Search ..... 347/29, 347/30, 31, 33, 35, 19
See application file for complete search history.

(56) References Cited

U.S. PATENT DOCUMENTS 7,568,780 B2 * 8/2009 Nishihara et al. ..... 347/19
7,712,863 B2 5/2010 Shimazaki

FOREIGN PATENT DOCUMENTS

JP 2006-258051 9/2006
JP 2008-194952 8/2008

* cited by examiner

*Primary Examiner* — Lamson Nguyen
(74) *Attorney, Agent, or Firm* — Workman Nydegger

(57) ABSTRACT

There is a first process of pressurizing the liquid introduced into the discharge pipe by driving a pump device and transferring the liquid to one end side of the discharge pipe; a second process of applying an electric field between a liquid reception unit, which is disposed to face the surface of the nozzle openings of the liquid ejecting head in a non-contact state, communicates with the other end side of the discharge pipe and is ejected with liquid from the nozzles, and the surface of the nozzle openings; a third process of detecting a change in voltage based on electrostatic induction when the pressurizing of the liquid in the discharge pipe due to the pump device is released; and a fourth process of detecting the discharge state of the liquid from the discharge pipe on the basis of detection result of the change in voltage.

5 Claims, 10 Drawing Sheets

MAINTENANCE METHOD FOR LIQUID EJECTING APPARATUS

The entire disclosure of Japanese Patent Application No. 2010-20221, filed Feb. 1, 2010 is expressly incorporated by reference herein.

BACKGROUND

1. Technical Field

The present invention relates to a maintenance method for a liquid ejecting apparatus.

2. Related Art

From the past, an ink jet recording apparatus has an ink jet recording head for discharging ink to a recording paper or the like. Since the ink jet recording head discharges ink to the recording paper or the like via nozzles, the ink thickens in the vicinity of the nozzles, bubbles are incorporated inside the nozzles, and there is a concern that discharging of the ink may not be effectively performed.

As a result, the ink jet recording apparatus is provided with a head cleaning device for preventing these phenomena.

The head cleaning device has a capping unit positioned to cover the nozzle and a pump for creating negative pressure inside the capping unit, and is configured to perform cleaning and maintenance by sucking the ink in the vicinity of the nozzles and the like using the pump.

As this type of pump, a tube pump is used which has a relatively simple configuration and is easily miniaturized. As such, in JP-A-2006-258051, a tube pump is disclosed where excessive suction, reverse flow and the like of a liquid such as ink do not occur.

However, in the techniques in the related art described above, there is the following problem.

On the downstream side of the pump (ink discharging side), if clogging occurs due to solidified ink or the like, the ink output gets backed up and pressure increases. In this case, there is a concern that the connection portion of the pump and the tube or the like will be disconnected and ink will leak out, and development of a method which efficiently detects clogging is desired.

SUMMARY

An advantage of some aspects of the invention is that a maintenance method for a liquid ejecting apparatus is provided which is capable of efficiently detecting clogging.

The invention for achieving the advantage described above adopts the following configuration.

According to an aspect the invention, there is provided a maintenance method for a liquid ejecting apparatus, which has a process of sucking a liquid from nozzles in a liquid ejecting head and discharging the liquid via a discharge pipe, including a first process of pressurizing the liquid introduced into the discharge pipe by driving a pump device and transferring the liquid to one end side of the discharge pipe, a second process of applying an electric field between a liquid reception unit, which is disposed to face the surface of the nozzle openings of the liquid ejecting head in a non-contact state, communicates with the other end side of the discharge pipe and is ejected with liquid from the nozzles, and the surface of the nozzle openings, a third process of detecting a change in voltage based on electrostatic induction when the pressurizing of the liquid in the discharge pipe due to the pump device is released, and a fourth process of detecting the discharge state of the liquid from the discharge pipe on the basis of detection result of the change in voltage.

Accordingly, in the maintenance method for the liquid ejecting apparatus of the aspect of the invention, in the case where there is an abnormality, such as clogging, in the liquid discharge state on the downstream side (liquid discharge side) of the pump device, in the first process, when the liquid is output to the one end side of the discharge pipe, the liquid pressure increases without the liquid being discharged. As a result, in the third process, when the output of the liquid to the one end side of the discharge pipe is halted, the liquid flows in reverse to the other end side of the discharge pipe toward the liquid reception unit due to the liquid pressure. The liquid which flowed in reverse is discharged to the liquid reception unit along with cavitations generated by the fall in liquid pressure and gas contained in the discharge pipe, and bubbles are generated in the liquid remaining in the liquid reception unit. When the bubbles reach and come into contact with the surface of the nozzle openings, since the surface of the nozzle openings and the liquid reception unit are electrically connected, it is possible to detect the change in voltage between the surface of the nozzle openings and the liquid reception unit. As a result, in the case where the change in voltage is detected, it is possible to efficiently detect that there is an abnormality, such as clogging, in the liquid discharge state on the downstream side of the pump device.

Also, in the maintenance method for the liquid ejecting apparatus described above, a sequence may be preferably adopted for detecting the change in voltage based on electrostatic induction when the liquid is ejected toward the liquid reception unit from the nozzles in the fourth process.

Due to this, according to the aspect of the invention, for example, even in the case where the surface of the nozzle openings and the liquid reception unit are not electrically connected due to a small amount of bubbles as described above, by detecting the difference in the change in voltage based on electrostatic induction when the liquid is ejected in cases where there are bubbles due to reverse flow and cases where there are no bubbles, it is possible to detect that there is an abnormality, such as clogging, in the liquid discharge state on the downstream side of the pump device.

Also, in the maintenance method for the liquid ejecting apparatus of the aspect of the invention, a sequence may be preferably adopted for repeatedly performing the first process, the third process and the fourth process when an abnormality is detected in the discharge state of the liquid from the discharge pipe.

Due to this, according to the aspect of the invention, since it is possible to repeatedly apply increases and decreases in pressure to the liquid on the downstream side of the pump device, it is possible to resolve an abnormality, such as clogging due to an impact, and recover normality in the discharge state.

Also, in the maintenance method for the liquid ejecting apparatus described above, a configuration may be preferably adopted where the liquid reception unit abuts against the surface of the nozzle openings and is provided with a cap member which performs negative-pressure suction of the nozzles by the driving of the pump device.

Due to this, according to the aspect of the invention, after the cap member abuts against the surface of the nozzle openings and negative-pressure suction of the nozzles is performed, it is possible to continuously perform the first to fourth processes and to efficiently perform the maintenance.

Also, in the maintenance method for the liquid ejecting apparatus described above, a sequence may be preferably adopted for making the amount of the liquid output to the one end side of the discharge pipe in the first process be less than the amount of the liquid output when performing negative-pressure suction of the nozzles using the cap member.

Due to this, according to the aspect of the invention, in the case that there is an abnormality, such as clogging, in the liquid discharge state on the downstream side (liquid discharge side) of the pump device, it is possible to prevent faults, such as the connection portion of the discharge pipe and the pump device being disconnected, caused by the liquid pressure due to the driving of the pump device in the first process.

BRIEF DESCRIPTION OF THE DRAWINGS

The invention will be described with reference to the accompanying drawings, wherein like numbers reference like elements.

FIG. 8A is a diagram illustrating a state immediately after an ink droplet is discharged, and FIG. 8B is a diagram illustrating a state where the ink droplet has landed on a detection region of the cap member.

DESCRIPTION OF EXEMPLARY EMBODIMENTS

Below, an embodiment of the maintenance method of the liquid ejecting apparatus of the invention will be described with reference to FIGS. 1 to 10.

In the embodiment, the case will be described where the liquid reception unit according to the invention is provided with the cap member. Also, in the embodiment, as the liquid ejecting apparatus according to the invention, an ink jet printer (referred to below as a printer 1) is exemplified.

In addition, the following embodiment illustrates an embodiment of the invention and does not limit the invention. Arbitrary modifications are possible within the range of the technical concept of the invention. Also, in order to make each of the configurations easier to understand, the number, reductions in the scale and the like of the actual configuration and each of the configurations may differ in the following diagrams.

Figure 1:
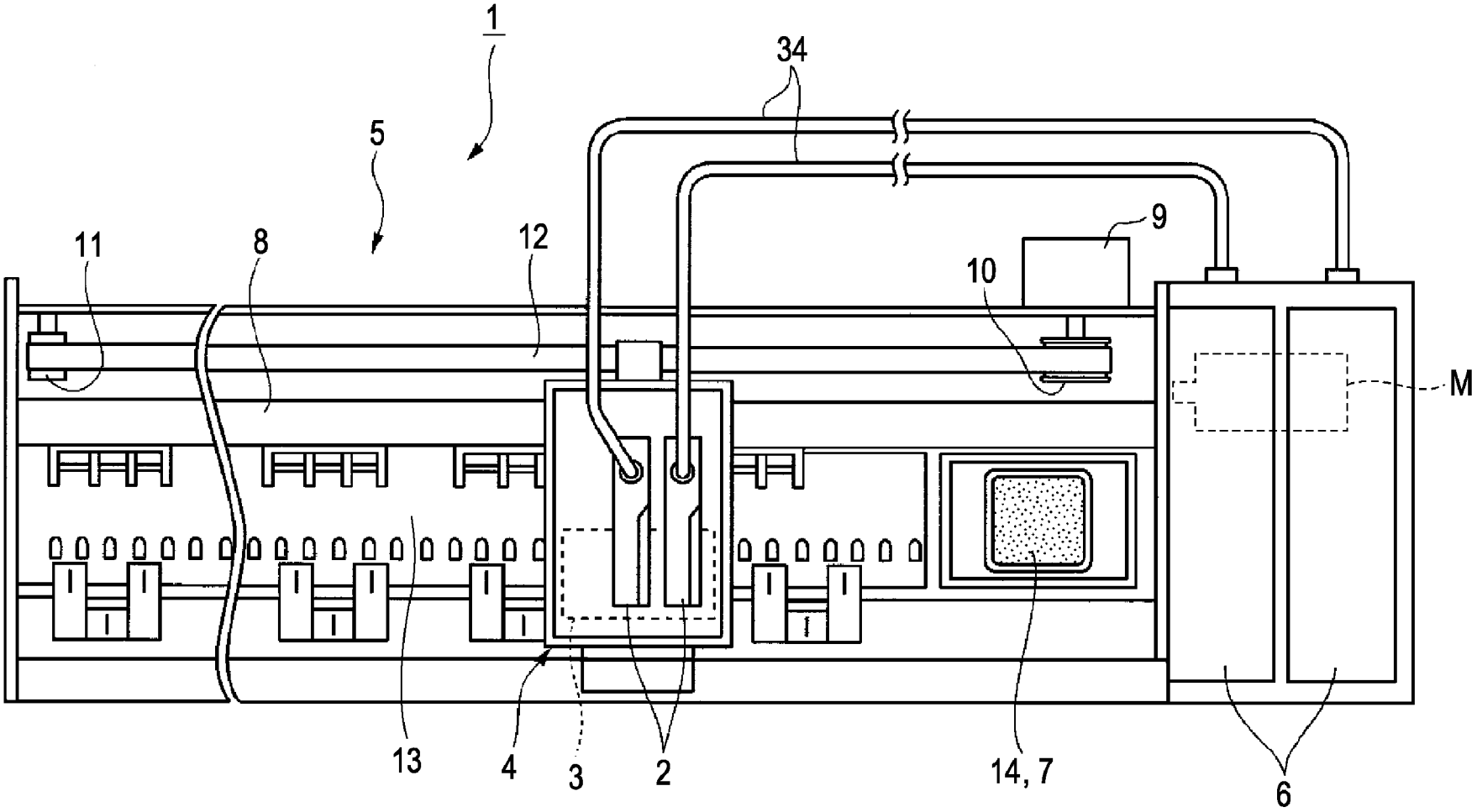
FIG. 1 is a partial exploded diagram illustrating a schematic configuration of a printer according to an embodiment of the invention.

FIG. 1 is a partial exploded diagram illustrating a schematic configuration of the printer 1 according to the embodiment of the invention.

The printer 1 is schematically configured from a carriage 4 mounted with a sub-tank 2 and a recording head (liquid ejecting head) 3 and a printer body 5.

In the printer body 5, there is provided a carriage transfer mechanism 65 (refer to FIG. 6) which transfers a carriage 4 back and forth, a paper feeding mechanism 66 (refer to FIG. 6) which transports a recording paper (liquid ejecting target) which is not shown, a capping mechanism 14 used in, for example, a cleaning operation where ink L which has thickened is sucked from each of the nozzles of the recording head 3, and an ink cartridge 6 which stores the ink L which is supplied to the recording head 3.

Also, the printer 1 is provided with an ink droplet sensor 7 (refer to FIGS. 4 and 6) which is capable of detecting an ink droplet D discharged from the recording head 3. The ink droplet sensor 7 is configured so as to charge the ink droplet D discharged from the recording head 3 and output a change in voltage as a detection signal based on electrostatic induction when the charged ink droplet D flies.

The details of the ink droplet sensor 7 will be described later.

The carriage transfer mechanism 65 is configured from a guide shaft 8 installed in a width direction of the printer body 5, a pulse motor 9, a driving pulley 10 which is connected to a rotation axis of the pulse motor 9 and is rotationally driven by the pulse motor 9, an idling pulley 11 provided on the opposite side in the width direction of the printer body 5 to the driving pulley 10, and a timing belt 12 which spans between the driving pulley 10 and the idling pulley 11 and is connected to the carriage 4.

Then, it is configured so that the carriage 4 is transferred back and forth in a main scanning direction along the guide shaft 8 by driving the pulse motor 9.

Also, the paper feeding mechanism 66 is configured from a paper feeding motor M, a paper feeding roller rotationally driven by the paper feeding motor M (neither of which is shown) or the like, and sequentially feeds the recording paper onto a platen 13 in coordination with recording (printing) operation.

Figure 4:
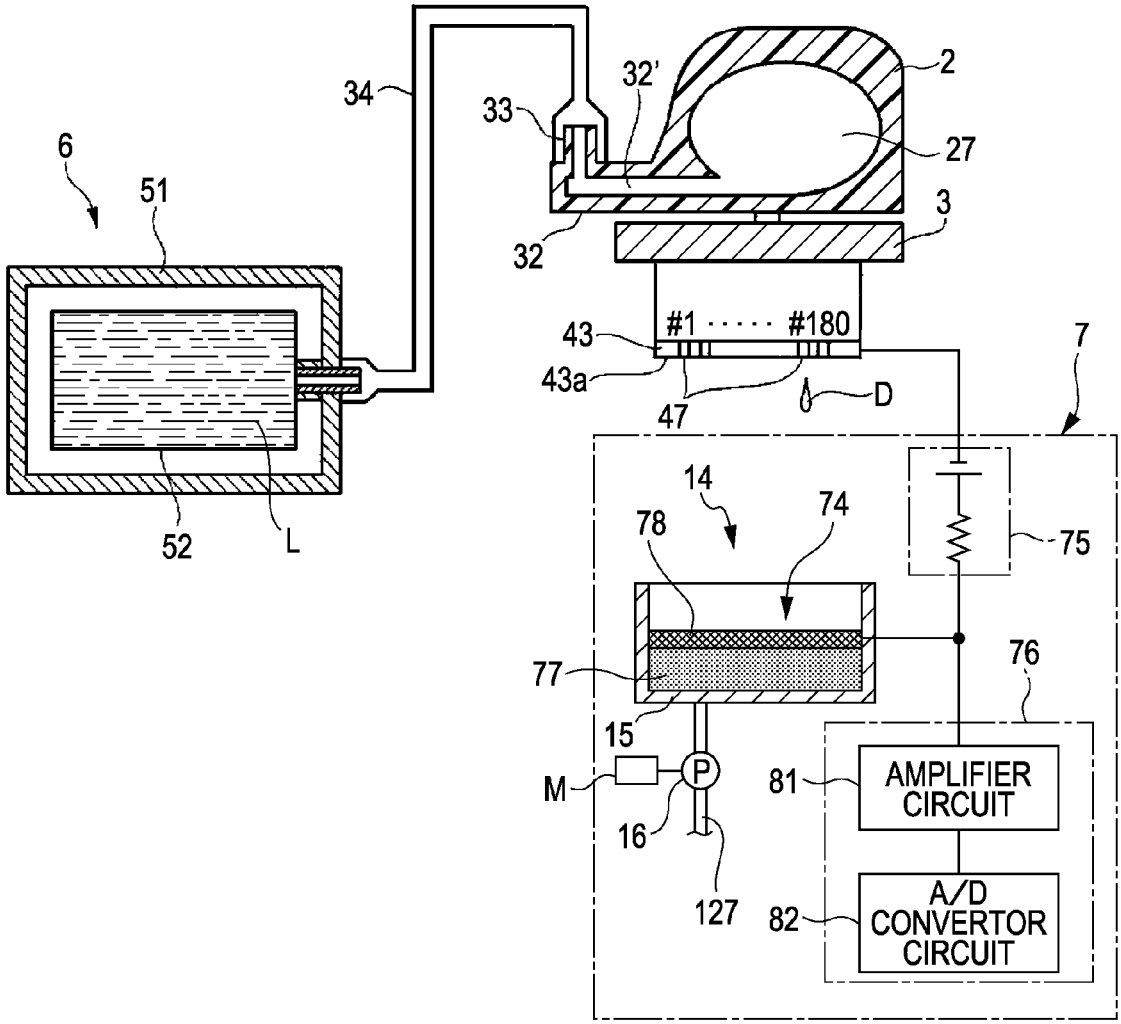
FIG. 4 is a pattern diagram illustrating a configuration of the recording head, an ink cartridge and an ink droplet sensor.

As shown in FIG. 4, the capping mechanism 14 is configured from a cap member 15, a suction pump (pump device) 16 and the like.

The cap member 15 is configured by a member molded from an elastic material, such as rubber, in a tray shape and is arranged at a home position. The home position is within the transfer range of the carriage 4 and is set in an end region further to the outside than the recording region. The home position is a place where the carriage 4 is positioned when the power is turned off or in a case where recording (liquid ejecting process) has not been performed for a long period of time.

In a case where the carriage 4 is positioned at the home position, the cap member 15 abuts against and seals the surface (that is, a nozzle opening surface 43*a*) of a nozzle substrate 43 (refer to FIG. 3) of the recording head 3. If the suction pump 16 is operated in the sealed state, the pressure inside the cap member 15 (sealed hollow portion) is reduced and the ink L in the recording head 3 is forcibly discharged from a nozzle 47.

Also, before the recording operation or during the recording operation by the recording head 3 and the like, the cap member 15 receives the ink droplets D in a flushing operation where the ink droplets D are discharged to discharge the thickened ink L, the bubbles and the like.

Figure 2:
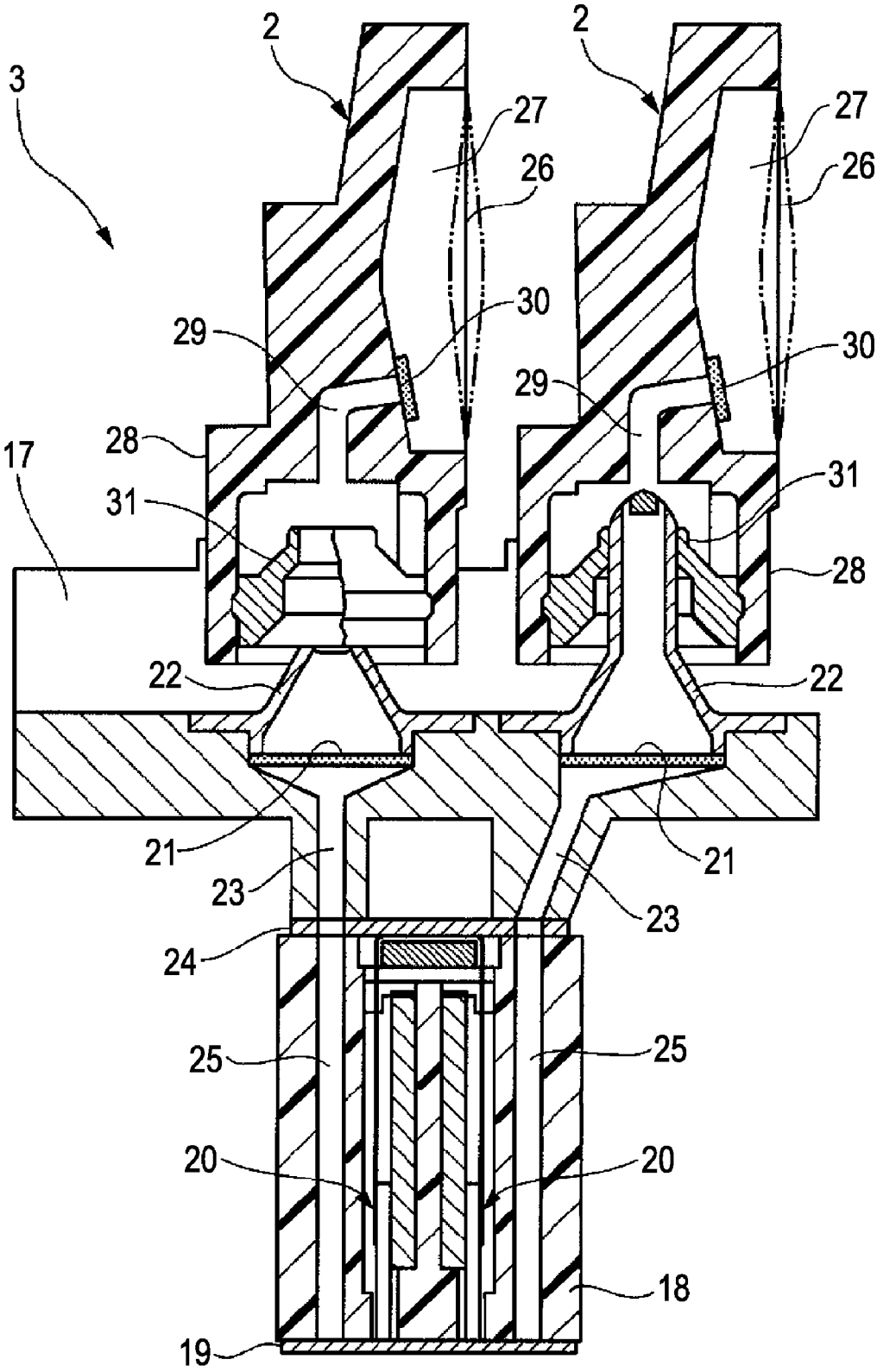
FIG. 2 is a cross-sectional diagram illustrating a configuration of a recording head.
Figure 3:
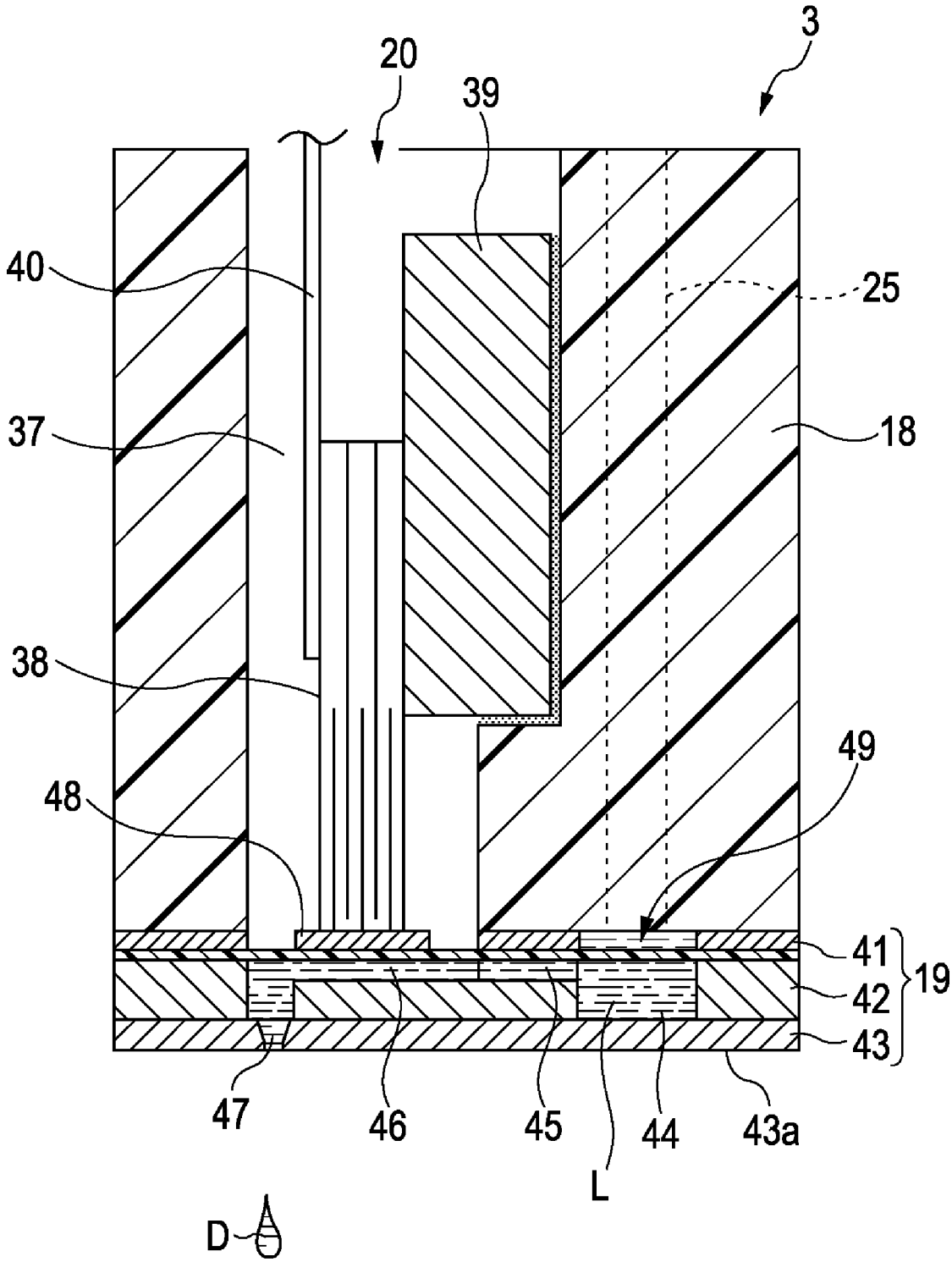
FIG. 3 is a cross-sectional diagram of the main parts of the recording head.

FIG. 2 is a cross-sectional diagram illustrating a configuration of the recording head 3, and FIG. 3 is a cross-sectional diagram of the main parts of the recording head 3. FIG. 4 is a pattern diagram illustrating a configuration of the recording head 3, the ink cartridge 6 and the ink droplet sensor 7.

The recording head 3 according to the embodiment is structurally configured of mainly an introduction needle unit 17, a head case 18, a flow path unit 19 and an actuator unit 20.

On the upper surface of the introduction needle unit 17, two ink introduction needles 22 are attached side by side in a state of a filter 21 being interposed. Sub-tanks 2 are mounted in the ink introduction needles 22. Also, in the inside of the introduction needle unit 17, an ink introduction path 23 is formed with regard to each of the ink introduction needles 22.

An upper end of the ink introduction path 23 is communicates with the ink introduction needles 22 through the filter 21, and a lower end of the ink introduction path 23 is connected to a case flow path 25 formed in an inner portion of the head case 18 through a packing 24.

In addition, in the embodiment, since there is the configuration using 2 types of ink, two sub-tanks 2 are provided, but the embodiment may, of course, also be applied to a configuration using 3 or more types of ink.

The sub-tanks 2 are molded by a material made of resin such as polypropylene. In the sub-tanks 2, concave portions which become ink chambers 27 are formed and the ink chambers 27 are partitioned by attaching a transmissive elastic sheet 26 on the opening surface of the concave portions.

Also, in the lower portion of the sub-tanks 2, needle connection sections 28 with the ink introduction needles 22 inserted therein protrude downwards. The ink chambers 27 of the sub-tanks 2 have shallow-bottomed mortar shapes and a position slightly lower than the vertical center of the side surface thereof faces the upstream openings of connection flow paths 29 which connect to the needle connection sections 28, and in the upstream openings of the connection flow paths 29, a tank section filter 30 which filters the ink L is attached.

In the inner spaces of the needle connection sections 28, sealing members 31, into which the ink introduction needles 22 are inserted in a liquid-tight manner, are attached. As shown in FIG. 4, in the sub-tank 2, an extension section 32 is formed with a communication groove section 32' which communicates with the ink chamber 27, and an ink flow inlet 33 protrudes from the upper surface of the extension section 32.

The ink flow inlet 33 communicates with an ink supply tube 34 which supplies the ink L retained in the ink cartridge 6. Accordingly, the ink L which passes through the ink supply tube 34 passes from the ink flow inlet 33 through the connection groove portion 32' and flows into the ink chamber 27.

The elastic sheet 26 described above is able to change shape in a direction which shrinks the ink chamber 27 and in a direction which expands the ink chamber 27. In addition, the fluctuation in the pressure of the ink L is absorbed by the damper function due to the changing shape of the elastic sheet 26. That is, due to the action of the elastic sheet 26, the sub-tank 2 functions as a pressure damper. Accordingly, the ink L is supplied to the recording head 3 side in a state where the sub-tank 2 absorbs fluctuations in pressure.

The head case 18 is a hollow box-shaped member made of synthetic resin, has the flow path unit 19 joined to the lower end surface, receives the actuator unit 20 in a reception space 37 (refer to FIG. 3) formed in the inside thereof, and has the introduction needle unit 17 attached to the upper end surface on the opposite side to the flow path unit 19 side in a state interposing the packing 24.

The case flow path 25 is provided to penetrate in a height direction in the inside of the head case 18. The upper end of the case flow path 25 communicates with the ink introduction path 23 of the introduction needle unit 17 through the packing 24.

Also, the lower end of the case flow path 25 communicates with a common ink chamber 44 in the flow path unit 19. Accordingly, the ink L introduced from the ink introduction needle 22 is supplied to the common ink chamber 44 side through the ink introduction path 23 and the case flow path 25.

The actuator unit 20 received in the reception space 37 of the head case 18 is configured from a plurality of piezoelectric vibrators 38 which is lined up in a comb shape, a fixing plate 39 with the piezoelectric vibrators 38 joined thereon, and a flexible cable 40 as a wiring member which supplies a driving signal from the printer body side to the piezoelectric vibrators 38. The fixing end sides of each of the piezoelectric vibrators 38 are joined on the fixing plate 39 and the free end sides of each of the piezoelectric vibrators 38 protrude more to the outside than the front end of the fixing plate 39. That is, each of the piezoelectric vibrators 38 is attached on the fixing plate 39 in a so-called cantilever state.

Also, the fixing plate 39 supporting the piezoelectric vibrators 38 is configured by, for example, stainless steel with a thickness of approximately 1 mm. In addition, the actuator unit 20 is housed and fixed in the reception space 37 by attaching the back surface of the fixing plate 39 to inner wall surface of the case which partitions the reception space 37.

The flow path unit 19 is manufactured by integrally forming flow path unit configuring members formed from a vibrating plate (a sealing plate) 41, a flow path substrate 42 and a nozzle substrate 43 which are joined by adhesive in a laminated state. The flow path unit 19 is a member which forms of a series of ink flow paths (liquid flow paths) from the common ink chamber 44, through an ink supply port 45 and the pressure chamber 46, to the nozzle 47. The pressure chamber 46 is formed as a chamber which is long and thin in a direction orthogonal to an arrangement direction of the nozzles 47 (a nozzle row direction). Also, the common ink chamber 44 is a chamber which communicates with the case flow path 25 and into which the ink L is introduced from the ink introduction needle 22 side.

In addition, the ink L introduced to the common ink chamber 44 is distributed and supplied to each of the pressure chambers 46 through the ink supply ports 45.

The nozzle substrate 43 arranged on the bottom of the flow path unit 19 is a thin metal substrate provided with openings in a row shape for the plurality of nozzles 47 in a pitch corresponding to a dot formation density (for example, 180 dpi). The nozzle substrate 43 of the embodiment is manufactured by a stainless steel substrate, and in the embodiment, the rows of the nozzles 47 are arranged in a total of 22 rows corresponding to each of the sub-tanks 2. In addition, one nozzle row is configured of, for example, 180 of the nozzles 47.

The flow path substrate 42 arranged between the nozzle substrate 43 and the vibrating plate 41 is a flow path member which becomes an ink flow path. More specifically, the flow path substrate 42 is a plate-shaped member with spaces partitioned and formed therein which become the common ink chamber 44, the ink supply port 45 and the pressure chamber 46.

In the embodiment, the flow path substrate 42 is manufactured by performing an anisotropic etching process on a silicon wafer which is a crystalline substrate. The vibrating plate 41 is a composite plate member with a double structure where an elastic film is laminated onto a support plate made of a metal such as stainless steel. In the portion of the vibrating plate 41 corresponding to the pressure chamber 46, by removing the support plate by etching or the like in a circular pattern, an island section 48 is formed joined with the front end of the piezoelectric vibrator 38, and this portion function as a diaphragm portion. That is, the vibrating substrate 41 is configured so that the elastic film surrounding the island section 48 can elastically change shape corresponding to the operation of the piezoelectric vibrator 38. Also, the vibrating plate 41 seals one of the opening surfaces of the flow path substrate 42 and functions also as a compliance section 49. The portion which corresponds to the compliance section 49 is set to be only an elastic film by removing the support plate by etching or the like in the same manner as the diaphragm portion.

In addition, in the recording head 3 described above, when the driving signal is supplied to the piezoelectric vibrator 38 via the flexible cable 40, the piezoelectric vibrator 38 shrinks and expands in the element longitudinal direction, and in accompaniment with this, the island section 48 moves in a direction closer to or a direction farther away from the pressure chamber 46. Due to this, the volume of the pressure chamber 46 changes and there are fluctuations in pressure in the ink L in the pressure chamber 46. Due to these fluctuations in pressure, the ink droplets D are discharged from the nozzle 47.

As shown in FIG. 4, the ink cartridge 6 is configured from a case member 51 formed in a hollow box shape and an ink pack 52 formed by a material with plasticity, and the ink pack 52 is accommodated in the reception chamber of the case member 51.

The ink cartridge 6 is configured to communicate with one end portion of the ink supply tube 34 and to supply the ink L in the ink pack 52 to the recording head 3 side using the water level difference with the nozzle opening surface 43*a* of the recording head 3. Specifically, the relative positional relationship in the weight direction of the ink cartridge 6 and the recording head 3 is set in a state so that an extremely small negative pressure is applied to the meniscus of the nozzle 47.

In addition, the supply of the ink L to the pressure chamber 46 and the discharge of the ink L in the pressure chamber 46 are performed using the fluctuations in pressure due to the driving of the piezoelectric vibrator 38.

As shown in FIG. 4, the ink droplet sensor 7 is configured from the cap member 15 as a liquid droplet reception unit arranged at the home position, a detection region 74 provided in an inner portion of the cap member 15, a voltage application circuit 75 which applies a voltage between the detection region 74 and the nozzle substrate 43 of the recording head 3, and a voltage detection circuit 76 which detects the voltage of the detection region 74.

The cap member 15 is a tray-shaped member with an opened upper surface and is manufactured from an elastic member such as an elastomer. An ink absorption body 77 is arranged in an inner portion of the cap member 15. The ink absorption body 77 has high ability to retain the ink L and is manufactured by, for example, a nonwoven cloth such as felt.

In addition, an electrode member 78 is arranged in mesh form in the upper surface of the ink absorption body 77.

The surface of the electrode member 78 corresponds to the detection region 74. The electrode member 78 is formed as a mesh with a grid shape from a metal such as stainless steel. As a result, the ink droplets D which land on the electrode member 78 pass through the gaps of the grid-shaped electrode member 78, and are absorbed and retained in the absorption body 77 which is positioned on the lower side.

In addition, an elastic member arranged on the upper surface of the cap member 15 is an insulating body, and it is set so that there is no electrical connection between the electrode member 78 and the recording head 3 even if the cap member 15 is closely adhered to the nozzle opening surface 43*a* of the recording head 3 as described later.

The voltage application circuit 75 electrically communicates with the electrode member 78 and the nozzle substrate 43 of the recording head 3 via a direct current (for example, 400V) and a resistive element (for example, 1MΩ) so that the electrode member 78 is positively charged and the nozzle substrate 43 of the recording head 3 is negatively charged.

The voltage detection circuit 76 is provided with an amplifier circuit 81 which amplifies and outputs a voltage signal of the electrode member 78, and an A/D convertor circuit 82 which converts the analog signal output from the amplifier circuit 81 to a digital signal and outputs it to a printer controller 55 (refer to FIG. 6) side. The amplifier circuit 81 amplifies and outputs the voltage signal of the electrode member 78 at a predetermined amplification rate. The A/D convertor circuit 82 converts the analog signal output from the amplifier circuit 81 to a digital signal and outputs it to the printer controller 55 side as a detection signal.

Figure 5:
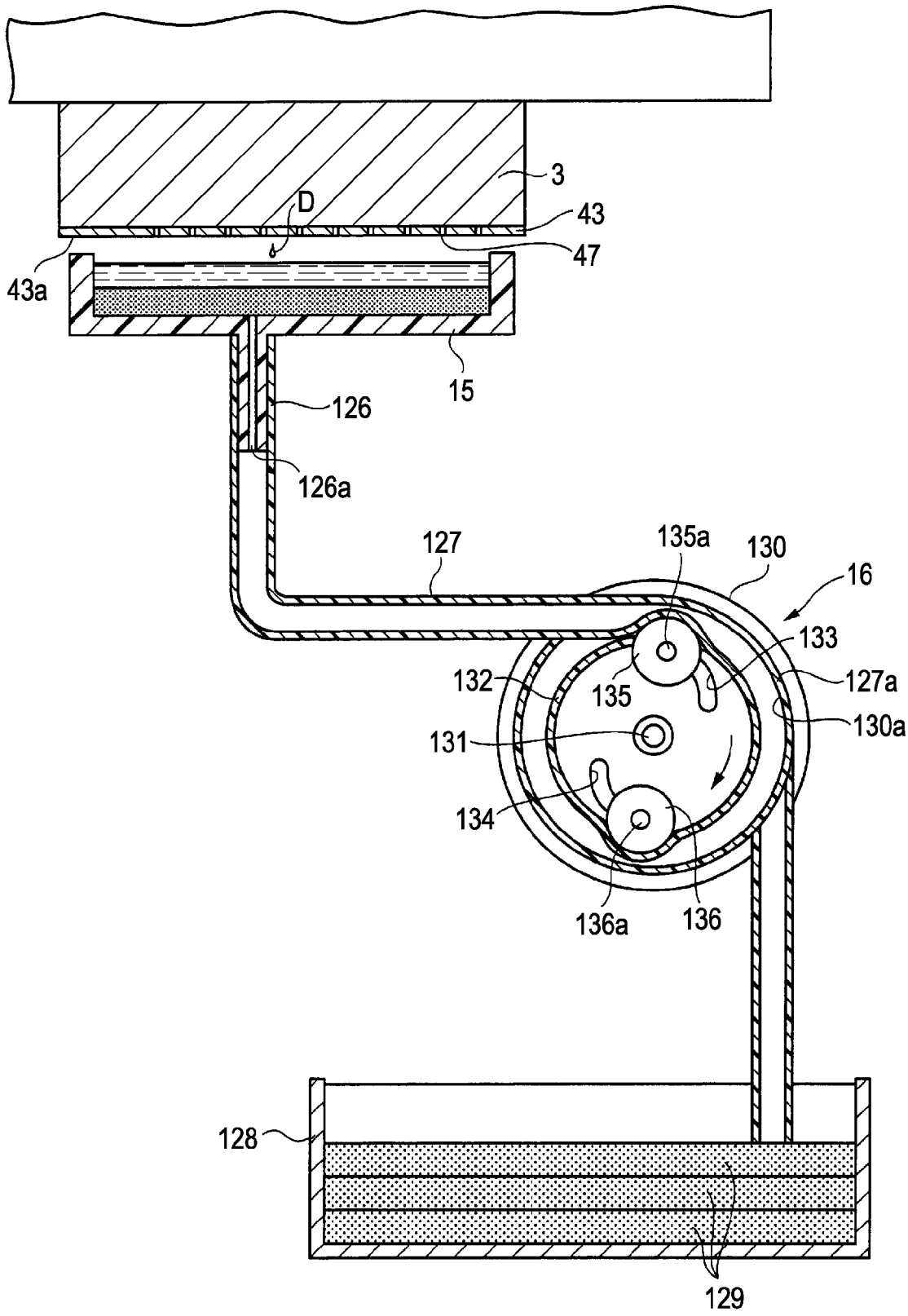
FIG. 5 is a diagram illustrating a configuration of a suction pump which communicates with a cap member.

FIG. 5 is a diagram illustrating a configuration of the suction pump 16 which communicates with the cap member 15.

In the bottom wall of the cap member 15, a discharge section 126, which discharges the ink L retained in the cap member 15, protrudes downward and a discharge flow pipe 126*a* is formed therein. The discharge section 126 communicates with one end portion of the discharge tube (discharge pipe) 127 formed from a material with plasticity, and the other end of the discharge tube 127 is inserted into a waste ink tank 128.

In addition, a waste ink absorption member 129 formed from a porous member is accommodated in the waste ink tank 128, and the ink L recovered by the waste ink absorption member 129 is absorbed. In addition, the waste ink tank 128 is provided below the platen 13.

The tube pump type suction pump 16 is provided between the cap member 15 and the waste ink tank 128. The suction pump 16 has a cylindrical case 130, and in the case 130, a pump wheel 132 which is circular in a plane view is accommodated so as to be able to rotate about a wheel shaft 131 provided in the shaft center of the case 130. In addition, an intermediate section 127*a* of the discharge tube 127 is accommodated in the case 130 so as to follow an inner circumferential wall 130*a* of the case 130.

In the pump wheel 132, a pair of roller guide grooves 133 and 134 with arc shapes which expand to the outside are formed to face each other and interpose the wheel shaft 131. Each of the roller guide grooves 133 and 134 has one end positioned on the outer circumference side of the pump wheel 132 and the other end positioned on the inner circumference side of the pump wheel 132. That is, both of the roller guide grooves 133 and 134 extend so as to become gradually farther from the outer circumference portion of the pump wheel 132 the farther from the one end thereof to the other end thereof. In both of the roller guide grooves 133 and 134, a pair of rollers 135 and 136, which are pressing means, pass and are supported respectively via rotation axes 135*a* and 136*a*. In addition, both of the rotation axes 135*a* and 136*a* slide freely respectively in both of the roller guide grooves 133 and 134.

As such, when the pump wheel 132 is rotated in the forward direction (direction of the arrow), both of the rollers 135 and 136 are moved to one end side of both of the roller guide grooves 133 and 134 (outer circumference side of the pump wheel 132) and rotate while the intermediate section 127*a* of the discharge tube 127 is sequentially pressed from the upstream side to the downside side. Due to the rotation, pressure is reduced in the inner portion of the discharge tube 127 positioned more to an upper stream side than the suction pump 16 and the inner portion of the discharge tube 127 is pressurized positioned more to a lower stream side than the suction pump 16.

Due to this, the ink L retained in the cap member 15 is absorbed due to the forward direction rotation operation of the pump wheel 132 and is gradually discharged in the direction of the waste ink tank 128.

Also, when the pump wheel 132 is rotated in a reverse direction (opposite direction to the direction of the arrow), both of the rollers 135 and 136 are moved to the other end side of both of the roller guide grooves 133 and 134 (inner circumference side of the pump wheel 132). Due to the movement, both of the rollers 135 and 136 are in a state of lightly coming into contact with the intermediate section 127*a* of the discharge tube 127, and the reduced pressure state of the upstream side of the inner portion of the discharge tube 127 is released (the pressurized state of the downstream side of the inner portion of the discharge tube 127 is released).

In addition, the pump wheel 132 is rotationally driven by the paper feeding motor M of the paper feeding mechanism 66.

Figure 6:
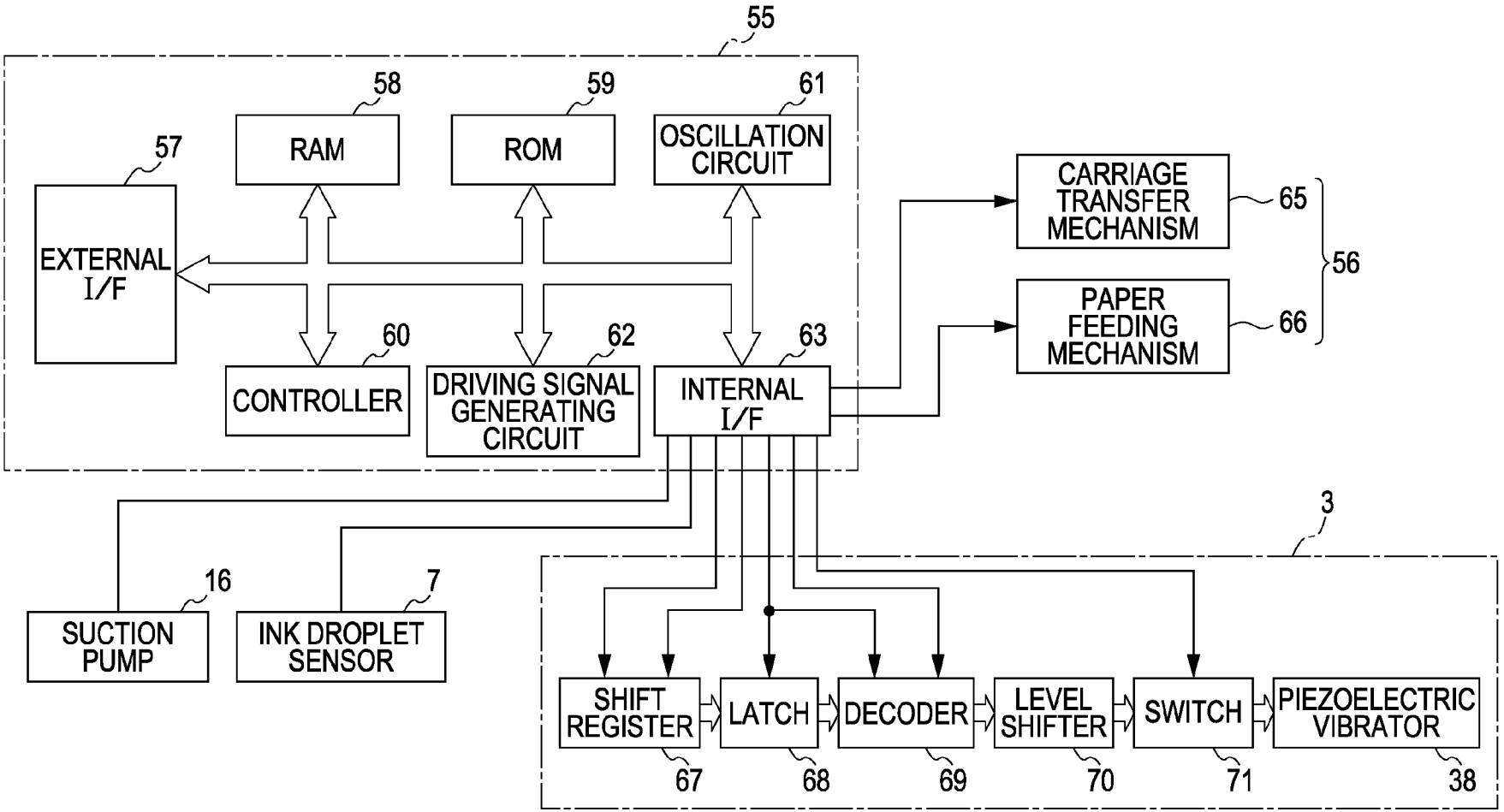
FIG. 6 is a block diagram illustrating an electrical configuration of the printer.

FIG. 6 is a block diagram illustrating an electrical configuration of the printer 1.

The printer 1 of the embodiment is schematically configured by the printer controller 55, a print engine 56 and the ink droplet sensor 7.

The printer controller 55 is provided with an external interface (external I/F) 57 where print data and the like is input from an external device such as a host computer, a RAM 58 which stores various types of data and the like, a ROM 59 which stores a control program for various types of control and the like, a controller 60 which performs overall control of each section according to the control program stored in the ROM 59, an oscillation circuit 61 which generates a clock signal, a driving signal generating circuit 62 which generates a driving signal supplied to the recording head 3, and an internal interface (internal I/F) 63 for outputting the driving signal, discharge data obtained by developing the print data for each dot and the like to the recording head 3.

The print engine 56 is configured from the recording head 3, the carriage transfer mechanism 65 and the paper feeding mechanism 66.

The recording head 3 is provided with a shift register 67 in which the discharge data is set, a latch circuit 68 which latches discharge data set in the shift register 67, a decoder 69 which translates discharge data from the latch circuit 68 and creates pulse selection data, a level shifter 70 which functions as a voltage amplifier, a switch circuit 71 which controls the supply of the driving signal to the piezoelectric vibrator 38, and the piezoelectric vibrator 38.

The controller 60 develops the discharge data corresponding to the dot pattern of the print data sent from the external apparatus and sends it to the recording head 3. In addition, in the recording head 3, the discharge of the ink droplets D is performed on the basis of received discharge data.

Also, the controller 60 functions as a cleaning processing unit which executes cleaning processing (maintenance) of the nozzle opening surface 43*a* of the recording head 3.

The cleaning processing includes a suction process of forcibly discharging the ink L from all of the nozzles 47 of the recording head 3, a wiping process of wiping the ink L attached to the nozzle opening surface 43*a*, and a flushing process of continuously discharging the ink droplets D from all of the nozzles 47 of the recording head 3.

The suction process forcibly discharges the ink L from each of the nozzles 47 toward the cap member 15 by attaching the cap member 15 closely to the nozzle opening surface 43*a* of the recording head 3, driving the suction pump 16 in a state where the cap member 15 covers the nozzle opening surface 43*a* and making the space covered by the cap member 15 (referred to below as a cap inner space S) to be in a negative pressure state. Due to the suction process, thickened ink and bubbles are forcibly discharged from the inside of the nozzles 47.

Although, on one hand, the suction process can discharge the thickened ink and the bubbles from the inside of the nozzles 47 in a cooperative manner, since time is required compared to the wiping process or the flushing process, the suction process is performed in cases when a concern that printing (recording) defects may occur is high such as when a recording process has not been performed for a long period of time or in cases when a printing defect occurs and there is a request from a user.

In addition, during the suction process, the controller 60 moves the cap member 15 to come into close contact with or move away from the recording head 3 and drives the suction pump 16 for a predetermined period of time.

The wiping process prevents color mixing of the ink L at the nozzle opening surface 43*a* and curved flight of the ink droplets D by wiping the ink L attached to the nozzle opening surface 43*a*.

The flushing process is a process which prevents nozzle clogging by discharging the thickened ink L and the bubbles from the inside of each of the nozzles 47 of the recording head 3, and ink droplets D are discharged, for example, approximately several tens to several hundreds of times from each of the nozzles 47 toward the cap member 15.

The wiping process and the flushing process are performed before and after the start of printing or periodically during printing.

The driving signal generating circuit 62 inputs data showing the amount of change of the voltage value of the discharge pulse supplied to the piezoelectric vibrator 38 of the recording head 3 and a timing signal which regulates a timing when the voltage of the discharge pulse is changed, and generates a driving signal (discharge pulse) based on the data and the timing signal.

When the discharge pulse described above is applied to the piezoelectric vibrator 38, the ink droplets D are discharged in the following manner. That is, when the discharge pulse is supplied, firstly, the piezoelectric vibrator 38 shrinks and the pressure chamber 46 expands. After the expanded state of the pressure chamber 46 is maintained for an extremely short period of time, the piezoelectric vibrator 38 rapidly expands. Accompanying this, the volume of the pressure chamber 46 shrinks to be equal to or less than a standard volume and the meniscus which is exposed to the nozzles 47 is rapidly pressurized toward the outside. Due to this, the ink droplets D of a predetermined amount of liquid are discharged from the nozzles 47. After this, the pressure chamber 46 is returned to the standard volume to restrict the vibration of the meniscus which accompanies the discharge of the ink droplets D to a short period of time.

In cases where predetermined conditions are met such as after power is turned on, after ink discharge has not been performed for a long period of time, when there is a request from a user, or the like, the printer 1 provided with the configuration above performs the maintenance (cleaning) process using the ink droplet sensor 7 and is controlled so that ink discharge defects (so-called missing dots) are prevented and resolved.

Figure 7:
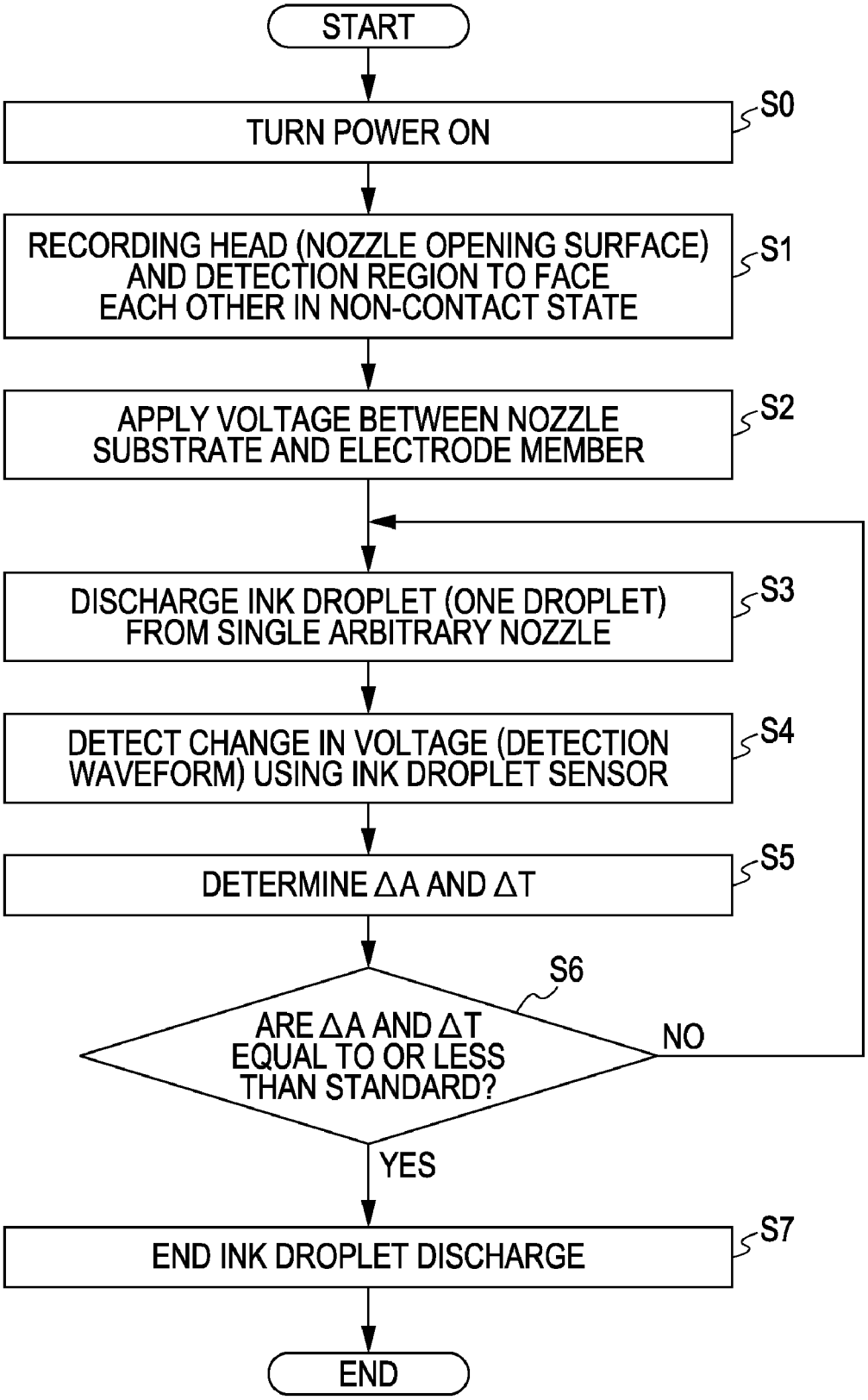
FIG. 7 is a flowchart illustrating the maintenance process using the ink droplet sensor.

FIG. 7 is a flowchart illustrating the maintenance process using the ink droplet sensor 7.

Figure 8A:
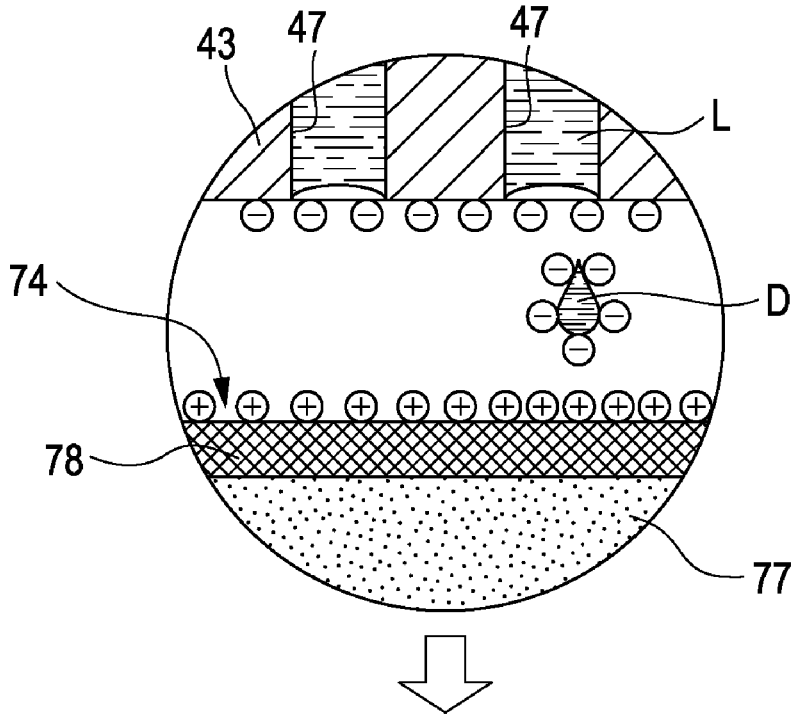
FIGS. 8A and 8B are pattern diagrams illustrating the principles of generating an induction voltage due to electrostatic induction.
Figure 8B:
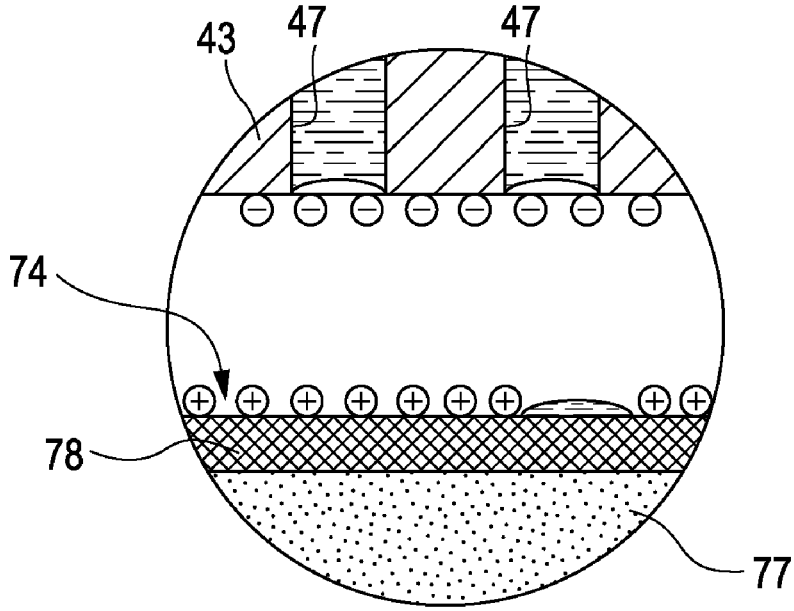

FIGS. 8A and 8B are pattern diagrams illustrating the principles of generating an induction voltage due to electrostatic induction. FIG. 8A is a diagram illustrating a state immediately after the ink droplet D is discharged, and FIG. 8B is a diagram illustrating a state where the ink droplet D has landed on the detection region 74 of the cap member 15.

Figure 9:
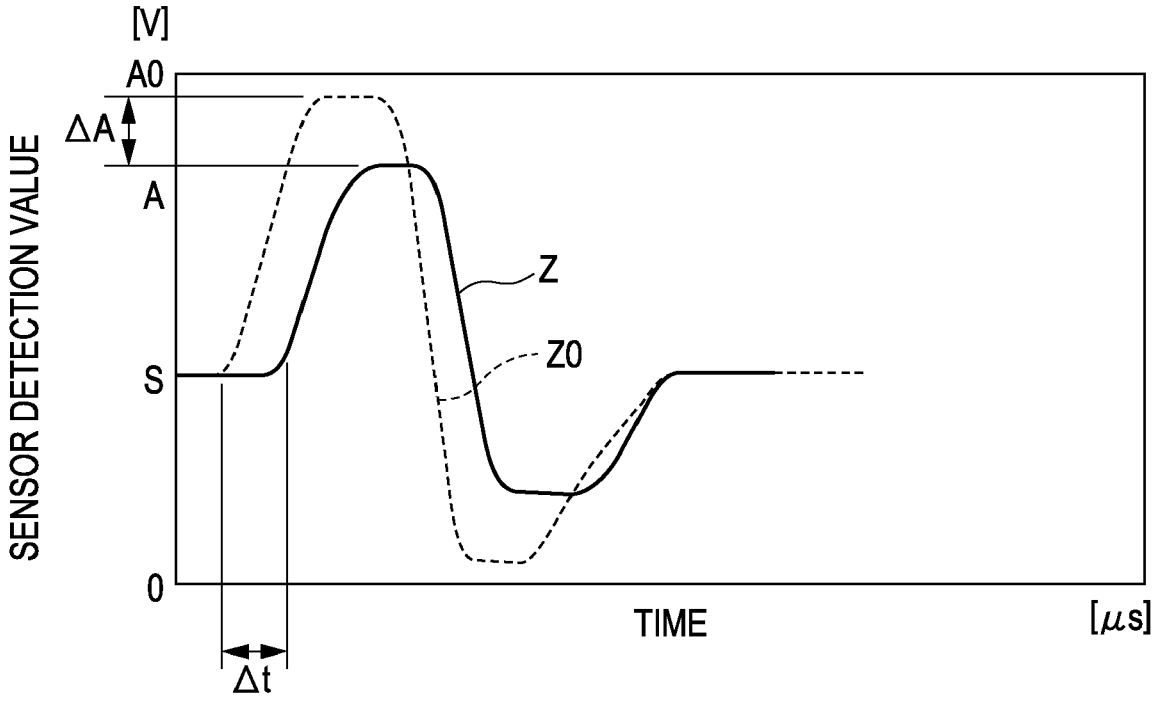
FIG. 9 is a diagram illustrating a waveform example of a detection signal (of one ink droplet) output from the ink droplet sensor.

FIG. 9 is a diagram illustrating a waveform example of a detection signal (of one ink droplet) output from the ink droplet sensor 7.

Before the power of the printer 1 is turned on (when the power is disconnected), the carriage 4 is in the home position and the cap member 15 abuts against and seals the surface of the nozzle substrate 43 of the recording head 3. This is so the ink L in each of the nozzles 47 of the recording head 3 does not come in contact with air and dry up. However, when the printer 1 is in a state when the power is disconnected for a long period of time, the ink L gradually dries up and is thickened.

As a result, when the power of the printer 1 is turned on, flushing is always executed before printing starts (step S0).

In the flushing before printing starts, first, the cap member 15 is lowered by a raising and lowering mechanism (not shown), the recording head 3 is positioned above the cap member 15 and the nozzle opening surface 43*a* of the recording head 3 and the detection region 74 (the electrode member 78) face each other in a non-contact state (step S1).

Then, a voltage is applied between the nozzle substrate 43 and the electrode member 78 using the voltage application circuit 75 (step S2).

Next, in the state where the voltage has been applied between the nozzle substrate 43 and the electrode member 78, the piezoelectric vibrator 38 is driven and the ink droplets D are discharged from a single arbitrary nozzle (step S3).

At this time, as the nozzle substrate 43 is negatively charged, as shown in FIG. 8A, a portion of the negative charge of the nozzle substrate 43 is transferred to the ink droplets D and the discharged ink droplets D are negatively charged. As the ink droplets D get closer to the detection region 74 of the cap member 15, the positive charge in the detection region 74 (the surface of the electrode member 78) increases due to electrostatic induction.

Due to this, the voltage between the nozzle substrate 43 and the electrode member 78 becomes higher than the initial voltage value in the state when the ink droplets D are not discharged due to an induction voltage generated by the electrostatic induction.

After this, as shown in FIG. 8B, when the ink droplets D land on the electrode member 78, the positive charge of the electrode member 78 is neutralized by the negative charge of the ink droplets D. As a result, the voltage between the nozzle substrate 43 and the electrode member 78 is below the initial voltage value.

Then, after this, the voltage between the nozzle substrate 43 and the electrode member 78 returns to the initial voltage value.

Accordingly, as shown in FIG. 9, a detection waveform output from the ink droplet sensor 7 is a waveform where, after the voltage has risen once from a standard voltage S, it falls until it is below the initial voltage value and then returns to the initial voltage value.

In this manner, the change in voltage is detected by the ink droplet sensor 7 when the ink droplets D are discharged from each of the nozzles 47 (step S4).

However, in a case where the ink droplets D have thickened, the discharge amount (amount of liquid) is reduced compared to a normal time even if the same discharge pulse is used. As a result, as shown by a solid line in FIG. 9, an amplitude A of the detection signal (detection waveform Z) output from the ink droplet sensor 7 is smaller (amplitude difference ΔA) compared to an amplitude A0 of a normal detection signal (ideal waveform Z0 indicated by a dotted line in FIG. 9). Also, also the period of time from the application of a discharge pulse signal DP to when the ink droplets D separate from the nozzle substrate 43 is delayed compared to the normal time (a timing when the voltage increases is deviated only by a time difference ΔT).

Accordingly, by comparing the amplitude A and the timing of the voltage increase of the detection waveform Z output from the ink droplet sensor 7 with those of the ideal waveform Z0 (by detecting ΔA and ΔT), it is possible to determine the thickening state of the ink L in each of the nozzles 47 of the recording head 3 (step S5).

Then, when performing flushing, in regard to the single arbitrary nozzle 47, whether or not the detection signal (detection waveform Z) from the ink droplet sensor 7 obtained using the ink droplets D discharged from the nozzle 47 is in a predetermined state (equal to or less than a standard value) (step S6). Then, in a case where the predetermined state is not reached, the discharge of the ink droplets D from the nozzle 47 is continued and the flushing process is completed when the detection signal becomes the predetermined state (step S7).

In this manner, the controller 60 performs the flushing before printing starts in regard to each of all of the nozzles 47 in the recording head 3.

Then, when the flushing before printing starts is completed, processing progresses to the recording (printing) process (step S7) where recording paper is transported (fed) by the paper feeding mechanism 66 and the ink droplets D are discharged toward the recording paper from each of the nozzles 47 of the recording head 3.

In the maintenance (cleaning) process described above, there are no problems when the discharge of ink to the waste ink tank 128 is smoothly performed in cases such as when the stoppage time is relatively short or when ink is used which is difficult to solidify, but in cases when thick ink is used or when ink is used for which it is easy for pigments and the like to solidify, clogging may occur in the discharge tube 127, and in particular, in a case where clogging occurs on the downstream side of the suction pump 16, there is a possibility that liquid pressure may increase due to ink being output by the suction pump 16 and faults such as liquid leakage occur. As a result, in the embodiment, when it is assumed that clogging will occur such as in cases when stoppage time exceeds a predetermined value or when ink is used which is easy to solidify, a process is provided to detect the discharge state of the ink from the discharge tube 127 before the maintenance (cleaning) process described above.

Figure 10:
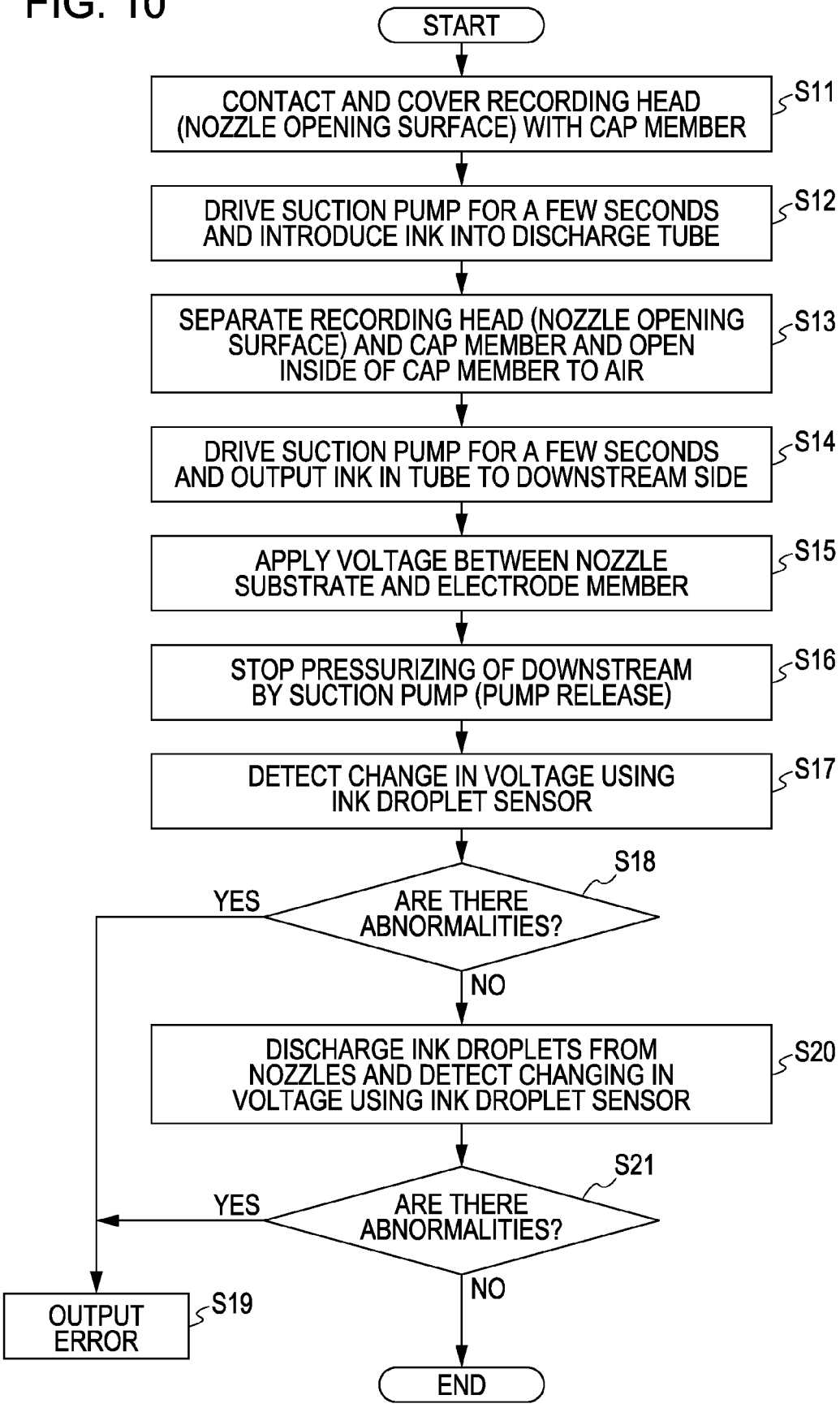
FIG. 10 is a flowchart illustrating the detection process of the ink discharge state.

Below, description will be made with reference to a flowchart shown in FIG. 10.

First, when there is a start command of the detection process of the discharge state, the controller 60 drives the carriage 4, so that the recording head 3 is moved to the home position and is positioned above the cap member 15. Then, the cap member 15 is raised by a raising and lowering mechanism (not shown) and the nozzle opening surface 43*a* of the recording head 3 and the top end of the cap member 15 come into close contact. Due to this, the nozzle opening surface 43*a* and the detection region 74 (the electrode member 78) of the cap member 15 approach and face each other in a non-contact state (step S11).

In addition, immediately after the power is turned on and the like, since the nozzle opening surface 43*a* of the recording head 3 and the cap member 15 are already maintained in a close contact state (to retain moisture), the processing progresses to step S2 in this state.

Next, the suction pump 16 is driven only for a period of time set in advance (a few seconds, for example, 2 seconds) and the space between the nozzle opening surface 43*a* and the cap member 15 (the cap inner space S) is made to be in a negative pressure state.

When the cap inner space S is in a negative pressure state, the ink L is sucked to the cap inner space S side from each of the nozzles 47 of the recording head 3 and is forcibly discharged. Due to this, the thickened ink L in the nozzles 47 and the bubbles in the recording head 3 are discharged toward the cap member 15 and are further introduced into the discharge tube 127 (step S12).

Next, the cap member 15 is lowered by the raising and lowering mechanism, so that the nozzle opening surface 43*a* of the recording head 3 and the cap member 15 are separated and the inside of the cap member 15 is open to the air (step S13).

After this, the suction pump 16 is driven again for a few seconds (for example, 5 seconds) and ink introduced into the discharge tube 127 is output to the downstream side (step S14). It is preferable if the amount of ink output at this time is made to be less than the output amount when the ink L is forcibly sucked from the nozzles 47 due to the suction process described above and is output via the discharge tube 127. By doing it in this manner, it can be avoided that a large burden is applied to the suction pump 16 or the discharge tube 127 due to the liquid pressure becoming too large even in cases when clogging occurs on the lower stream side than the suction pump 16.

Next, a voltage is applied between the nozzle substrate 43 and the electrode member 78 by the voltage application circuit 75 (step S15). In addition, the order of step S14 and step S15 may be reversed.

Next, in the state where the voltage is being applied between the nozzle substrate 43 and the electrode member 78, the output of ink to the downstream side by the suction pump 16 (pressurizing of ink) is stopped (released) (step S16). In more detail, the pump wheel 132 is driven to rotate in the reverse direction (the opposite direction to the direction of the arrow; counterclockwise direction in FIG. 5) and the pressurized state of the inner portion of the downstream side of the discharge tube 127 is released.

Here, in a case where clogging has not occurred in the discharge tube 127, only the output of ink is stopped. However, in a case where clogging has occurred in the discharge tube 127, since it enters a state where the liquid pressure of the ink between the clogging and the suction pump 16 increases and pressure accumulates due to the output of ink in step S14, by releasing the suction pump 16, the ink with accumulated pressure flows in reverse in the discharge tube 127 toward the cap member 15.

The ink flowing in reverse is discharged to the cap member 15 along with cavitations generated by the fall in liquid pressure and bubbles contained in the discharge tube 127, and bubbles are generated in the ink retained in the cap member 15. When the bubbles reach and come in contact with the nozzle opening surface 43*a*, since the nozzle opening surface 43*a* and the cap member 15 are electrically connected, a zero potential is detected between the nozzle opening surface 43*a* and the cap member 15 in the ink droplet sensor 7 (step S17).

The controller 60 determines whether or not there is an abnormality in the discharge state of the ink on the basis of detection value of the ink droplet sensor 7 (step S18), and as described above, in the case that there is no voltage difference between the nozzle opening surface 43*a* and the cap member 15, an error is output indicating that there is an abnormality (step S19) or the operation of the apparatus is stopped.

On the other hand, in the case that no clogging occurs in the discharge tube 127, since there is no reverse flow of ink, from the detection value of the ink droplet sensor 7 showing the standard voltage S shown in FIG. 9, the controller 60 determines that there is no abnormality in the discharge state of the ink in step S18.

In addition, even in the case that it is determined that there is no abnormality in the discharge state of the ink in step S18, there is a possibility that small bubbles are generated which do not reach the nozzle opening surface 43*a*. As a result, in step S20 of the embodiment, ink droplets are discharged from the nozzles 47 toward the cap member 15 and steps S3 to S6 described above are performed using the ink droplet sensor 7.

Then, the detection value of the ink droplet sensor 7 is determined (step S21) and in the case that a signal similar to the detection signal (detection waveform Z, Z0) shown in FIG. 9 is obtained, the discharge abnormality detection process is completed. In the case that a signal different to the detection signal (detection waveform Z, Z0) is obtained, an error is output indicating that there is an abnormality in the discharge state of the ink (step S19) or the operation of the apparatus is stopped.

As described above, in the embodiment, by detecting the change in voltage based on electrostatic induction of the cap member 15 after the pressurization of the ink in the discharge tube 127 due to the suction pump 16 is released, it is possible to efficiently detect clogging in the discharge tube 127 without having to provide a separate device for detecting clogging.

Also, in the embodiment, since the change in voltage is also detected in a case where ink droplets are further discharged from the nozzles 47, it is possible to more accurately perform detection even in cases where only minor clogging occurs.

Also, in the embodiment, since the amount of ink output when pressure has accumulated due to the suction pump 16 is made to be less than the output amount when the ink L is forcibly sucked from the nozzles 47 due to the suction process and is output via the discharge tube 127, it is possible to avoid a large burden being applied to the suction pump 16 or the discharge tube 127 due to the liquid pressure becoming too large and to increase the level of safety even in cases when clogging occurs on the lower stream side than the suction pump 16.

A preferred embodiment according to the invention is described above with reference to the attached diagrams, but it goes without saying that the invention is not limited to this embodiment. In the embodiment described above, the various forms, combinations and the like of each constituent member shown are one example, and various modifications based on design requirements and the like are possible without departing from the gist of the invention.

For example, in the embodiment described above, there is a configuration where the ink droplet sensor 7 is provided in the cap member 15, but the invention is not limited to this, and in the case where a flushing box used when performing flushing as described above is provided so as to be able to switch the connection to the suction pump 16 between the cap member 15 and the flushing box, the ink droplet sensor 7 may be provided in the flushing box. In that case, when performing steps S11 to S13 described above, the cap member 15 and the suction pump 16 communicate and when the steps from S14 onward are performed, the flushing box and the suction pump 16 may communicate.

Also, in the embodiment described above, there is sequence where an error is output immediately in a case where an abnormality in the discharge state of the ink is detected from the detection results of the ink droplet sensor 7, but the invention is not limited to this. For example, there may be a sequence where an error is output in a case where an abnormality is detected also after a process of performing a recovery process where, for example, steps S11 to S17 are repeated, an increase and reduction in pressure is repeatedly applied to the ink on the downstream side of the suction pump 16, and due to the impact from this, the abnormality such as clogging is resolved and a normal discharge state is recovered.

Due to this, it is possible to automatically resolve clogging and the stoppage of the operation of the apparatus due to the error and the reduction in productivity can be prevented.

In addition, in the embodiment described above, the fluid ejecting apparatus is described using the case of an ink jet printer as an example, but without being limited to an ink jet printer, it may be an apparatus such as a copier or a facsimile.

Also, in the embodiment described above, the fluid ejecting apparatus is described using the case of a fluid ejecting apparatus which ejects a liquid such as ink as the fluid as an example. However, the fluid ejecting apparatus of the invention can be applied as a fluid ejecting apparatus which ejects or discharges liquids other than ink. As the liquids which can be ejected by the fluid ejecting apparatus, a body in liquid form where particles of a functional material are dispersed or dissolved and a fluid body in gel form are included.

Also, in the embodiment described above, as the liquid ejected from the fluid ejecting apparatus, not only ink but a liquid corresponding to a specific purpose can be applied. By providing an ejecting head which is capable of ejecting the liquid corresponding to the specific purpose in the fluid ejecting apparatus, ejecting the liquid corresponding to a specific purpose from the ejecting head and attaching the liquid to the specific object, it is possible to manufacture a specific device. For example, it is possible to apply the fluid ejecting apparatus of the invention as a fluid ejecting apparatus which ejects a liquid (a body in liquid form) with a material such as an electrode material, a colorant used in manufacturing liquid crystal displays, EL (electroluminescence) displays, field emission displays (FED) or the like which are dispersed (dissolved) in a predetermined dispersing medium (solvent).

Also, as the fluid ejecting apparatus, it may be a fluid ejecting apparatus which ejects a biological organic material used in manufacturing biochips or may be a liquid ejecting apparatus used as a precision pipette which ejects a liquid which is a sample.

Furthermore, the invention can be applied to one type of any of the fluid ejecting apparatuses of a fluid ejecting apparatus which precisely ejects lubrication oil in a precision device such as a watch or a camera, a fluid ejecting apparatus which ejects a transmissive resin liquid such as an ultraviolet curing resin onto a substrate to form, for example, miniature hemispherical lenses (optical lenses) used in optical communication elements and the like, a fluid ejecting apparatus which ejects an acid or an alkali etching liquid to perform etching of substrates and the like, or a fluid ejecting apparatus which ejects a gel.

What is claimed is:

1. A maintenance method for a liquid ejecting apparatus, which has a process of sucking a liquid from nozzles in a liquid ejecting head and discharging the liquid via a discharge pipe, comprising:

a first process of pressurizing the liquid introduced into the discharge pipe by driving a pump device and transferring the liquid to one end side of the discharge pipe;

a second process of applying an electric field between a liquid reception unit, which is disposed to face the surface of the nozzle openings of the liquid ejecting head in a non-contact state, communicates with the other end side of the discharge pipe and is ejected with liquid from the nozzles, and the surface of the nozzle openings;

a third process of detecting a change in voltage based on electrostatic induction when the pressurizing of the liquid in the discharge pipe due to the pump device is released; and a fourth process of detecting the discharge state of the liquid from the discharge pipe on the basis of detection result of the change in voltage.

2. The maintenance method for a liquid ejecting apparatus according to claim 1, wherein, the change in voltage is detected in the fourth process on the basis of electrostatic induction when the liquid is ejected toward the liquid reception unit from the nozzles.

3. The maintenance method for a liquid ejecting apparatus according to claim 1, wherein, the first process, the third process and the fourth process are repeatedly performed when an abnormality is detected in the discharge state of the liquid from the discharge pipe.

4. The maintenance method for a liquid ejecting apparatus according to claim 1, wherein, the liquid reception unit abuts against the surface of the nozzle openings and is provided with a cap member which performs negative-pressure suction of the nozzles through driving of the pump device.

5. The maintenance method for a liquid ejecting apparatus according to claim 4, wherein, the amount of the liquid output to the one end side of the discharge pipe in the first process is made to be less than the amount of the liquid output when performing negative-pressure suction of the nozzles using the cap member.

* * * * *